US005333866A

United States Patent [19]

Tanzer et al.

[11] Patent Number: 5,333,866

[45] Date of Patent: Aug. 2, 1994

[54] PINBALL MACHINE HAVING AN INTERACTIVE PLAYFIELD

[75] Inventors: Raymond C. Tanzer, Naperville; Peter J. Hanchar, Chicago, both of Ill.

[73] Assignee: Premier Technology, Bensenville, Ill.

[21] Appl. No.: 90,807

[22] Filed: Jul. 12, 1993

[51] Int. Cl.[5] ..... A63F 7/38

[52] U.S. Cl. ..... 273/118 R; 273/118 A; 273/120 A; 273/121 A; 273/119 A

[58] Field of Search ..... 273/118-121, 273/127 R, 127 B, 127 C, 127 D

[56] References Cited

U.S. PATENT DOCUMENTS

| | | | |
|---|---|---|---|
| 4,354,680 | 10/1982 | Kmiec . | |
| 4,650,190 | 3/1987 | Geiger . | |
| 4,981,298 | 1/1991 | Lawlor et al. . | |
| 5,112,049 | 5/1992 | Borg . | |
| 5,149,093 | 9/1992 | Schilling et al. | 273/121 A X |
| 5,149,094 | 9/1992 | Tastad | 273/121 A |
| 5,181,722 | 1/1993 | Krutsch et al. | 273/118 A X |

*Primary Examiner*—Jessica J. Harrison
*Assistant Examiner*—Raleigh W. Chiu
*Attorney, Agent, or Firm*—Arnold, White & Durkee

[57] ABSTRACT

A pinball machine has a plurality of ball-deflecting components mounted to a playfield section. The playfield section is selectively translated in response to player input, so that the ball is deflected by the ball-deflecting components to locations selected by the player. The translation of the playfield section, for example, is responsive to the conventional push-button switches that are operated by the player for activating flippers, and in this case the push-buttons activate respective solenoids for translating the playfield section in two different directions. The playfield section, however, could be translated in different directions along two or three orthogonal axes in response to a more complex player-input device such as a joy-stick. In a specific embodiment, the ball-deflecting components define different sloping lanes on the playfield section, and the player operates the flipper push-button switches to translate the playfield section from side-to-side in order to bump the ball from one lane to another. A microcomputer is responsive to ball-sensing switches on the playfield section, and awards the player for lane changes.

26 Claims, 12 Drawing Sheets

PINBALL MACHINE HAVING AN INTERACTIVE PLAYFIELD

RELATED APPLICATIONS

The present application contains disclosure that is similar to disclosure in a U.S. patent application by Raymond C. Tanzer and Peter J. Hanchar entitled "Pinball Machine Having a Conveyor Belt Ball Lift," filed coincident with the filling of the present application.

BACKGROUND OF THE INVENTION

1. Field of the Invention

The present invention relates generally to pinball machines, and more particularly to an interactive game feature. The present invention specifically relates to a playfield section that is selectively moved in response to player input, ball position or game sequences.

2. Background Art

A pinball game has an inclined playfield and a plurality of play features arranged on the playfield. A player operates flippers to direct a ball at playfield features such as targets or ramps to score points. The configuration of the playfield features may change as a result of the presence of the ball. Drop targets, for example, drop beneath the playfield when struck by the ball.

The flippers are typically pivoted by solenoids to strike the ball. Typically one or more flippers that pivot in a clockwise direction are mounted at lower right peripheral positions of the playfield, and one or more flippers that pivot in a counter-clockwise direction are mounted at lower left peripheral positions of the playfield. The flippers on the right side of the playfield are activated by a player-operated push-button on the right side of the game housing, and the flippers on the left side of the playfield are activated by a player-operated push-button on the left side of the game housing.

The configuration of the playfield may be changed in response to a game sequence programmed into a microcomputer that also keeps track of the player's score. The microcomputer is responsive to various switches such as ball target switches, and switches that sense the state or configuration of the playfield. As described in Borg, U.S. Pat. No. 5,112,049, for example, the configuration of an entire section of the playfield can be changed by rotating the playfield section to expose different components that were previously stored below the playfield surface.

SUMMARY OF THE INVENTION

The present invention provides a pinball machine having a playfield section that is selectively moved in response to player input, ball position or game sequences.

Briefly, in accordance with a basic aspect of the present invention, there is provided a method of interactive control of a ball in a pinball machine in response to player input. The pinball machine has a plurality of ball-deflecting components mounted to a playfield section. The method includes the steps of: a) placing the ball on the playfield section; and b) selectively moving the playfield section in response to the player input, so that the ball is deflected by the ball-deflecting components to locations selected by the player.

In accordance with another aspect, the present invention provides a pinball machine including, in combination: a main playfield having ball-deflecting components mounted thereon; means operable by a player for projecting a ball over the main playfield to contact the components; a playfield section mounted to the main playfield for movement with respect to the main playfield, the playfield section having ball-deflecting components mounted thereon for deflecting the ball when the ball rolls over the playfield section; and means operable by a player and connected between the playfield section and the main playfield for moving the playfield section with respect to the main playfield to cause the ball to be deflected to selected locations by the ball-deflecting components mounted on the playfield section.

In accordance with yet another aspect, the present invention provides a pinball machine including, in combination: a main playfield having ball-deflecting components mounted thereon; a pair of flippers for projecting a ball over the main playfield to contact the components; a pair of switches operable by the player for activating the flippers; a playfield section mounted to the main playfield for movement with respect to the main playfield, the playfield section having a plurality of ball-deflecting components mounted thereon; and a pair of solenoids coupled between the main playfield and the playfield section for moving the playfield section in different directions, the solenoids being electrically operable in response to the switches, whereby the player may control deflection of the ball by the ball-deflecting components on the playfield section.

In a specific embodiment, the playfield section is mounted above the main playfield, and the ball is placed on the playfield section by elevating the ball from the main playfield. The ball-deflecting components define different sloping lanes on the playfield section, and the player operates the push-button flipper switches to move the playfield section from side-to-side in order to bump the ball from one lane to another. A microcomputer is responsive to ball-sensing switches on the playfield section, and awards the player for lane changes.

In an alternative embodiment, the player operates a joy-stick and a "trigger" switch on the joy-stick to translate the playfield section in different directions along three orthogonal axes. The trigger switch translates the playfield section upward in a vertical direction to make the ball jump above the playfield section, for example, to jump over obstacles on the playfield section.

The present invention therefore captivates a player's interest and attention by providing a very responsive means for controlling the ball during play in lieu of the conventional flippers. Moreover, the present invention is compatible with the use of conventional flippers, and may use the player-operated switches that activate the flippers for control of the playfield section.

BRIEF DESCRIPTION OF THE DRAWINGS

Other objects and advantages of the invention will become apparent upon reading the following detailed description with reference to the accompanying drawings wherein.

Figure 1:
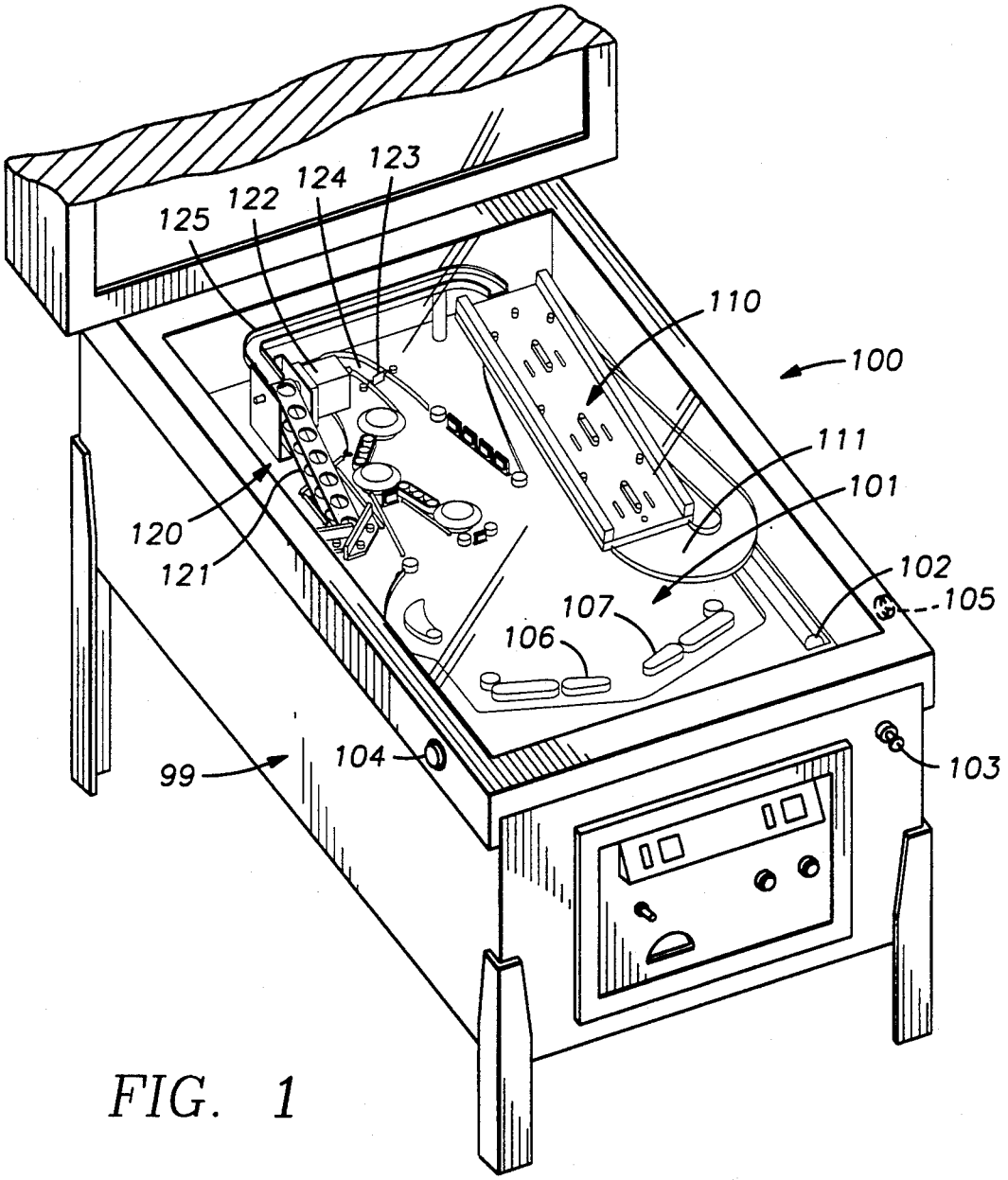
FIG. 1 is a perspective view of a pinball machine incorporating the present invention.

While the invention is susceptible to various modifications and alternative forms, specific embodiments thereof have been shown in the drawings and will be described in detail. It should be understood, however, that it is not intended to limit the invention to the particular forms shown, but on the contrary, the intention is to cover all modifications, equivalents, and alternatives falling within the scope of the invention as defined by the appended claims.

DETAILED DESCRIPTION OF THE PREFERRED EMBODIMENT

Turning now to FIG. 1 of the drawings, there is shown a pinball machine 100 employing the present invention. The pinball machine 100 has a housing 99 in which a main playfield 101 is mounted. The player initially pulls and releases a plunger 103 to project a ball 102 over the playfield 101. During play, the player depresses left and right flipper push-button switches 104, 105 to activate left and right flippers 106, 107 to keep the ball in play.

As shown in FIG. 1, the pinball machine 100 has an elevated playfield section 110 in the shape of an elongated rectangle. As will be further shown in FIG. 3, the playfield section 110 is sufficiently elevated that the ball 102 may pass beneath it when rolling over the main playfield 101, for example, after the player initially pulls and releases the plunger 103 to project the ball over the main playfield 101. Both the main playfield 101 and the elevated playfield section 110 are inclined toward the front of the pinball machine 100. When the ball is on the elevated playfield, it rolls downward and is collected by a vacuum-formed plastic ramp 111. The ramp 111 directs the ball towards the back of the main playfield 101, where the ball exits the ramp 111 and rolls forward over the main playfield and under the elevated playfield section 110.

To elevate the ball from the main playfield 101 to the elevated playfield section 110, the pinball machine 100 includes a ball elevator 120 having a perforated conveyor belt 121 driven by an electric motor 122. The electric motor, for example, is a continuously-excited 120 VAC motor with an internal gear train providing a speed of 30 revolutions per minute. The perforations in the conveyor belt 121 are circular and have an internal diameter that is about 80% of the diameter of the ball. The perforations, for example, have a diameter of between ¾ of an inch and ⅞ths of an inch for elevating a ball having a diameter of 1 and 1/16 of an inch. The best size for the perforations depends on the degree of incline of the belt. A relatively large diameter is best for a steep incline, and a relatively small diameter is best for a gradual incline. For the pinball machine as shown in FIG. 1, the diameter of the perforations was chosen to be 0.875 inches.

For the ball to reach the ball elevator 120, the player must activate one of the flippers 106, 107 at the proper time to project the ball to a checkered target 123 at the entrance of a passage 124 directing the ball to the lower end of the conveyor belt 121. The conveyor belt 121 lifts the ball to an elevated vacuum-formed plastic ramp 125 that drops the ball onto the rear portion of the elevated playfield section 110. A metal wire ramp could be used in lieu of the plastic ramp 125.

The elevated playfield section 110 has mounted to it a number of conventional ball-deflecting components and ball-sensing switches. The elevated playfield section 110, however, is not mounted in a fixed position with respect to the housing 99 or the main playfield 101 of the pinball machine 100. Instead, the forward end of the elevated playfield section 110 is pivotally mounted to the main playfield 101, and the rear end of the elevated playfield is mounted for movement in a transverse direction, as will be further described with reference to FIGS. 3, 4 and 5. Moreover, when the ball is on the elevated playfield section 100, the rear end of the elevated playfield section moves toward the right when the player presses the right flipper button 105, and the rear end of the elevated playfield section moves toward the left when the player presses the left flipper button 104. Therefore, the player can inter-actively control the path of the ball when the ball rolls down the elevated playfield section.

The elevated playfield section 110 and the ball elevator 120 are more particularly configured and interconnected in accordance with a particular game theme. For the specific construction shown in FIG. 1, the game theme is down-hill slalom skiing. The ball elevator 120 represents a chair lift, and the elevated playfield 110 represents a hill having a slalom course.

Figure 2:
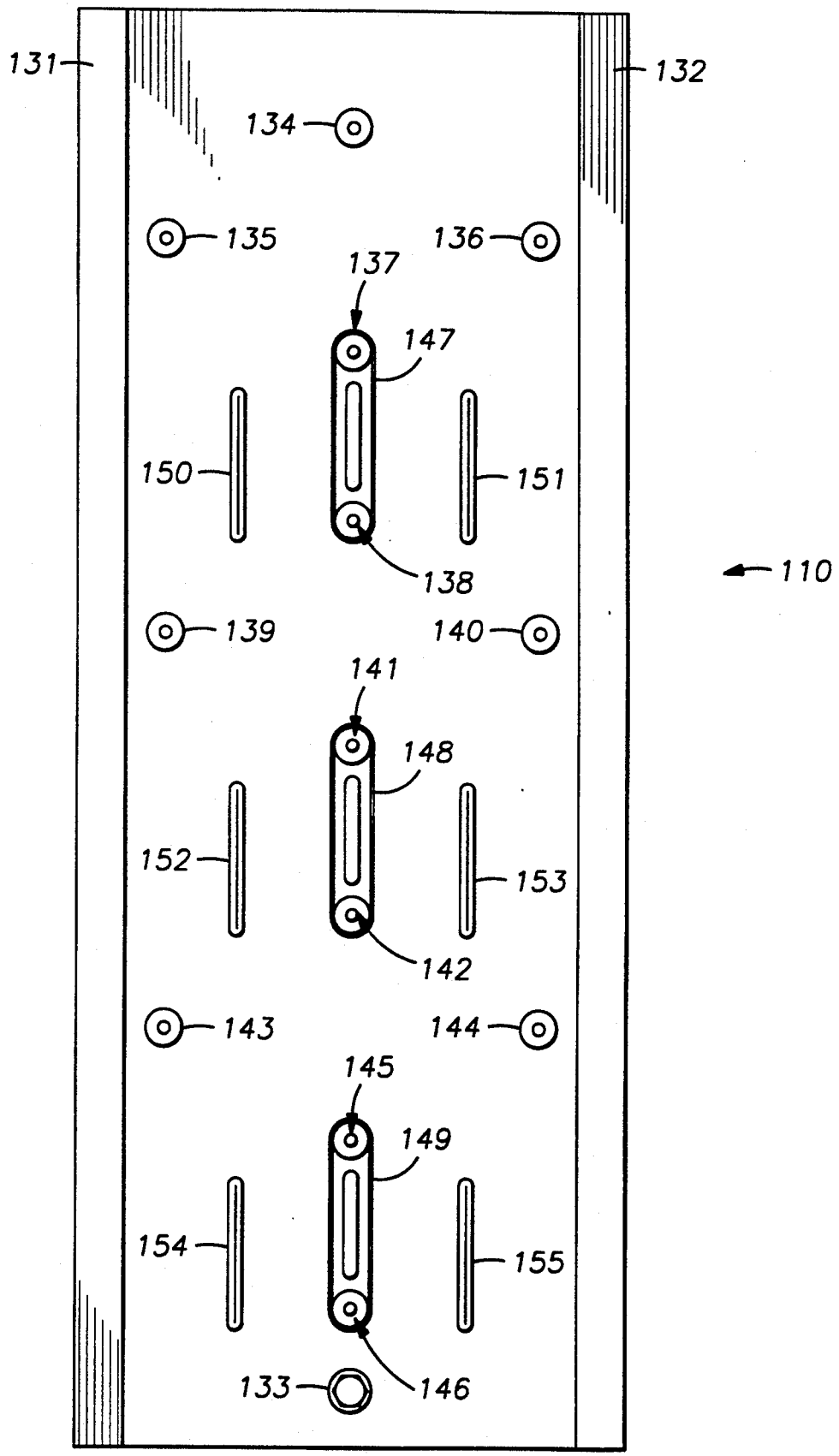
FIG. 2 is a plan view of an elevated interactive playfield section used in the pinball machine of FIG. 1.

Turning now to FIG. 2, there is shown a plan view of the elevated playfield section 110. To contain the ball, a pair of wood side rails 131, 132 are fastened to the elevated playfield section 110. The front of the elevated playfield section pivots about a screw 133. To deflect the ball, a number of bumpers 134 to 146 are strategically arranged on the elevated playfield 110. Each of these bumpers 134 to 146 has a "minipost" secured to the elevated playfield, and a rubber ring forced onto the "minipost." Plastic lane dividers 147, 148, and 149 are mounted between respective neighboring pairs of the bumpers (137, 138), (141, 142), and (143, 144), so as to create a pair of 1 and ¼ inch wide lanes.

Figure 3:
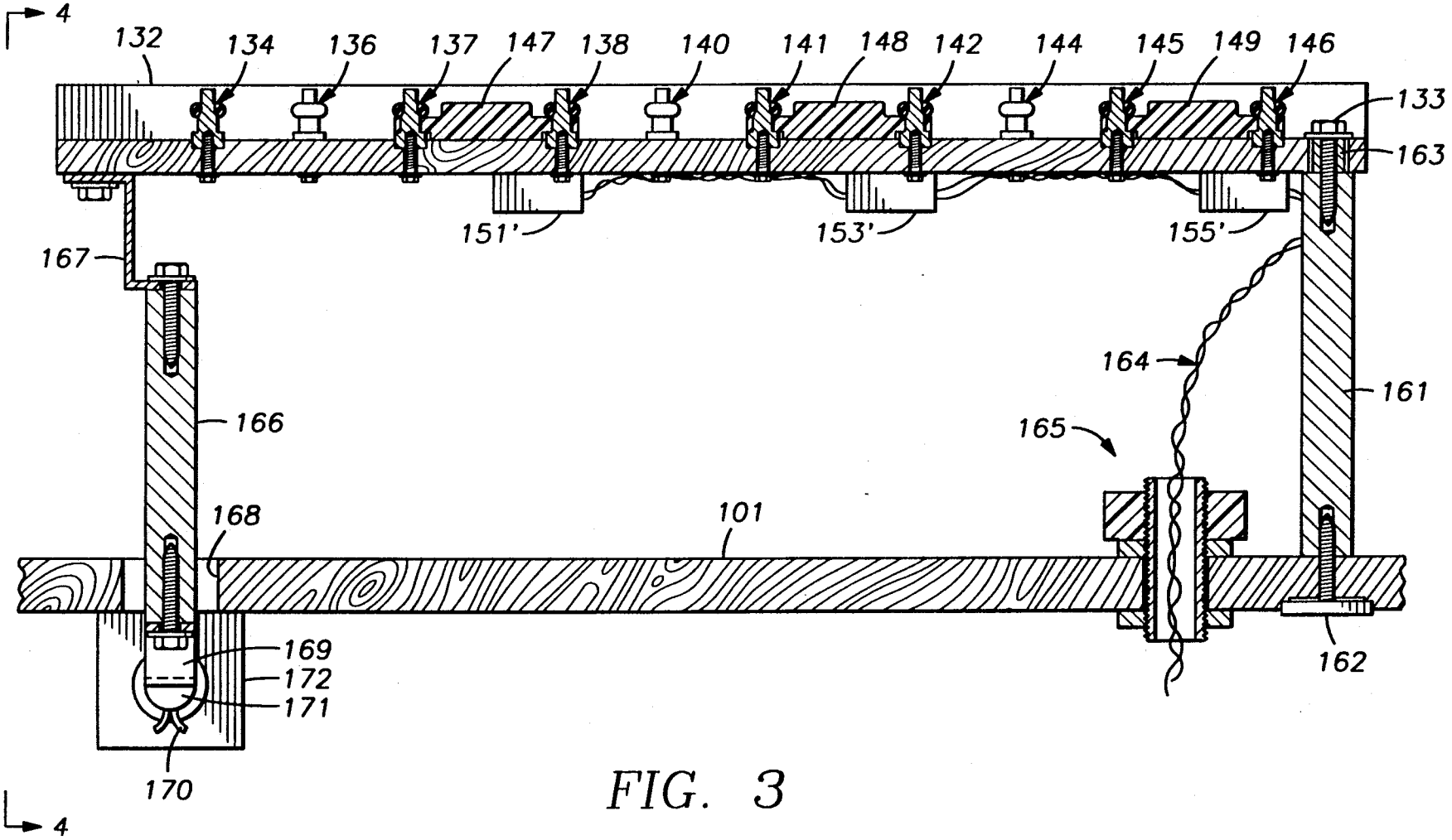
FIG. 3 is a side view, in section along line 3—3 in FIG. 4, of the elevated interactive playfield section of FIG. 2.
Figure 4:
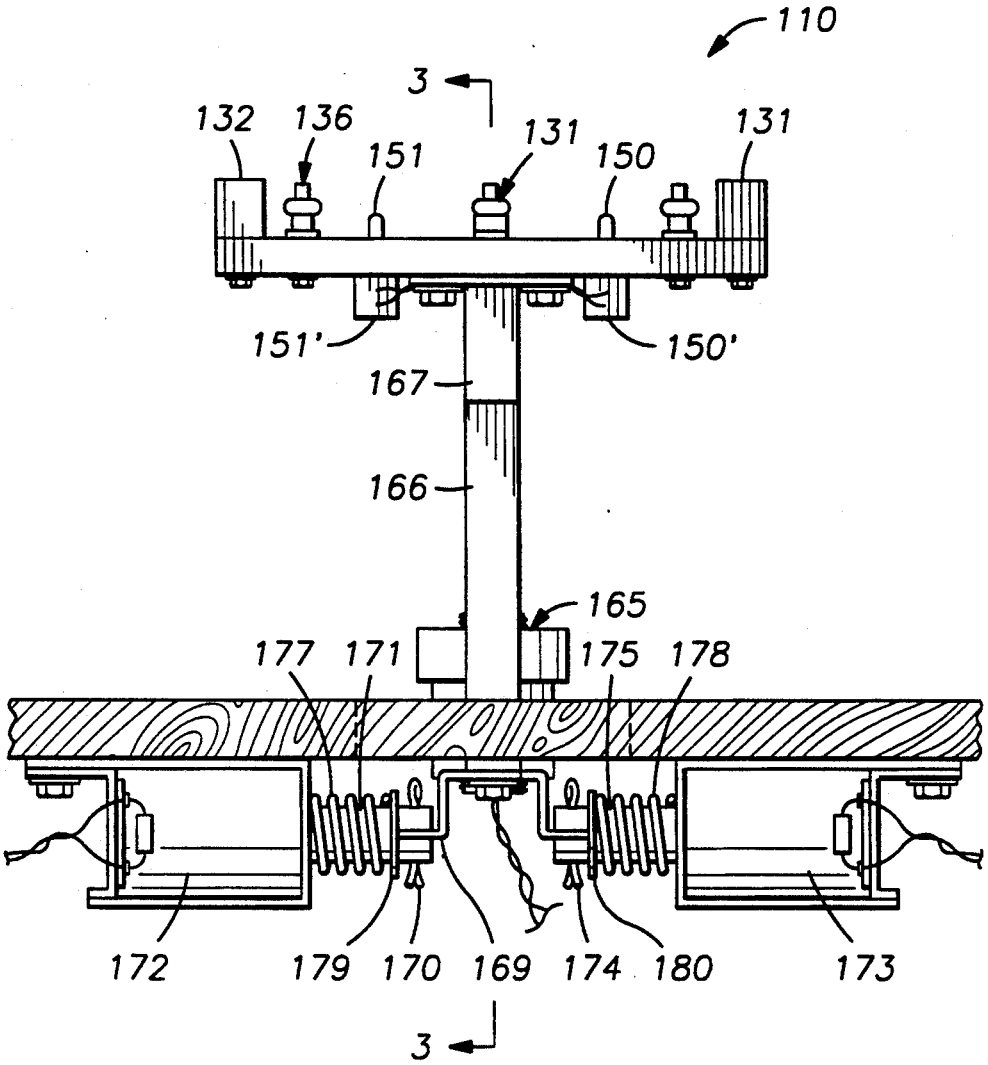
FIG. 4 is a rear end view, in section along line 4—4 in FIG. 3, of the elevated interactive playfield section of FIG. 2.

Wire-forms 150 to 155 extend upward through slots in the elevated playfield section 110 from respective roll-over switches 150' to 155' mounted underneath the elevated playfield section 110 (such as switches 150', 151', 153', and 155' seen in FIGS. 3 and 4). These ball-sensing switches are connected to a microcomputer (201 in FIGS. 7 or 201' in FIG. 8) in order to award the player points for causing the ball to shift lanes. A specific program for performing these functions will be described below with reference to FIG. 9.

Turning now to FIG. 3, there is shown a side view of the elevated playfield section 110 and its mounting to the main playfield 101. The front end of the elevated playfield section 110 is mounted on a pivot standoff 161 that is fixed to the main playfield 101 by a number eight T-nut 162. The pivot standoff runs up through a clearance hole in the elevated playfield section 110 and has a shoulder which supports the elevated playfield section. The elevated playfield section is retained on the pivot standoff 161 by the screw 133. The screw 133 does not clamp the elevated playfield section to the pivot standoff 161. Instead, when the screw 133 is fully tightened, there is a clearance between the bottom of the head of the screw 133 and the top surface of the elevated playfield section. This clearance is set by a spacer 163 that is slightly longer than the thickness of the elevated playfield section. Alternatively, the clearance could be set by machining a shoulder onto the pivot standoff 161, so that in effect the spacer 163 would be integral with the pivot standoff, or else the spacer 163 could be eliminated, and the length of the screw 163 and the depth of the hole into which the screw 163 is threaded could be selected to obtain the clearance when the screw 163 is fully tightened. In any case, the elevated playfield section 110 can freely pivot with respect to the pivot standoff 161.

As shown in FIG. 3, wires 164 from the ball-sensing switches 156, 157, 158 are routed toward the pivot stand-off 161 and then pass downward through a hole in the main playfield 101. The ball should not be permitted to strike the wires when the ball rolls over the surface of the main playfield 101. As shown in FIG. 3, for example, the wires pass through the center of a bumper generally designated 165.

As further shown in FIG. 3, the rear end of the elevated playfield 110 is mounted to a working standoff 166 via a mounting plate 167. The working standoff 166 and the pivot standoff 161 can be any desired length. The working standoff 166 passes through a rectangular aperture 168 cut in the main playfield 101, and extends from a link coupler 169. A cotter pin 170 pins the link coupler 169 to the plunger shaft 171 of a solenoid 172.

Figure 5:
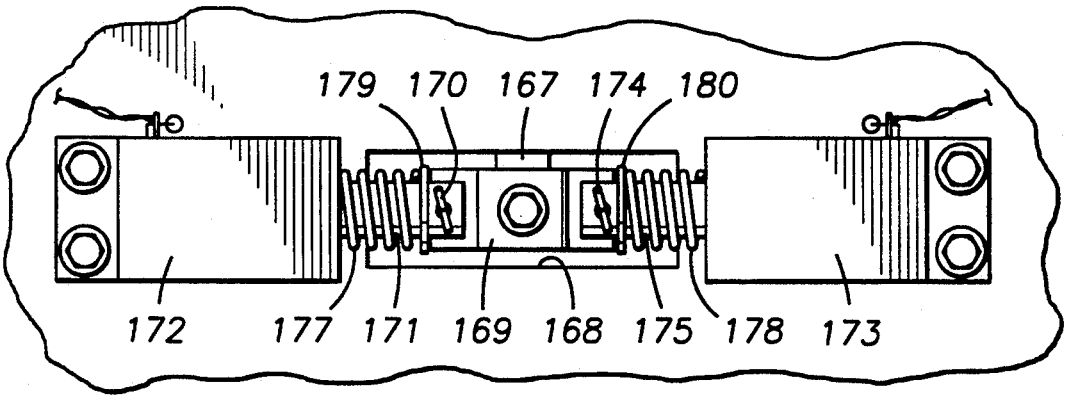
FIG. 5 is a bottom view of solenoids and a linkage to the interactive playfield section of FIG. 2.

The mounting of the link coupler 169 is further shown in the rear end view of FIG. 4, and the bottom view of FIG. 5. A second solenoid 173 is mounted in a coaxial and anti-parallel relationship with respect to the solenoid 172, and a cotter pin 174 pins the link coupler 169 to the plunger shaft 175 of the second solenoid 173. Therefore the working standoff 166 transfers horizontal movement of the solenoid plunger shafts 171, 175 to the elevated playfield 110. Return springs 177, 178 and washers 179, 180 are assembled over the plunger shafts 171, 175 and abut against the link coupler 169 so that the working standoff 166 is disposed in a central position when neither of the solenoids 172, 173 are energized. When one of the solenoids 172, 173 is energized, the working standoff 166 is pulled to the left or right, which moves the elevated playfield section 110 in a desired direction.

Figure 6:
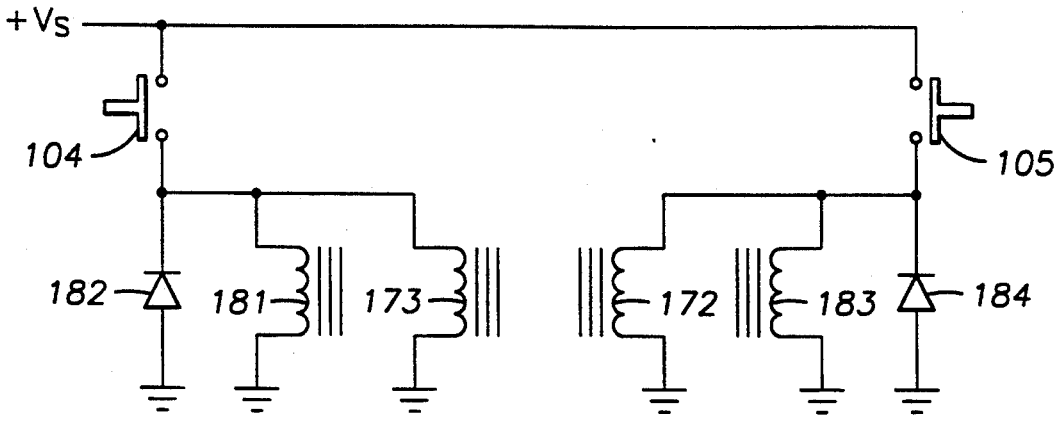
FIG. 6 is a schematic diagram showing a simple method of wiring the solenoids of FIG. 5 to the player-operated flipper switches in the pinball machine of FIG. 1, so that the flipper switches activate both the solenoids of FIG. 5 and the solenoids that actuate the conventional flippers.

Turning now to FIG. 6, there is shown a simple circuit for permitting the player to activate the solenoids 172, 173. The left flipper switch 104 is connected to a solenoid 181 that actuates the left flipper (106 in FIG. 1), and a damper diode 182 that prevents arcing of the switch contacts. In a similar fashion, the right flipper switch 105 is connected to a solenoid 183 that actuates the right flipper (107 in FIG. 1), and a damper diode 184. In the circuit of FIG. 6, the solenoid 172 is wired in parallel with the solenoid 183, and the solenoid 173 is wired in parallel with the solenoid 181. Therefore, each of the flipper switches 104, 105 simultaneously activates one of the flippers 106, 107 and also causes the rear end of the elevated playfield section 110 to be shifted to the left or right.

Figure 7:
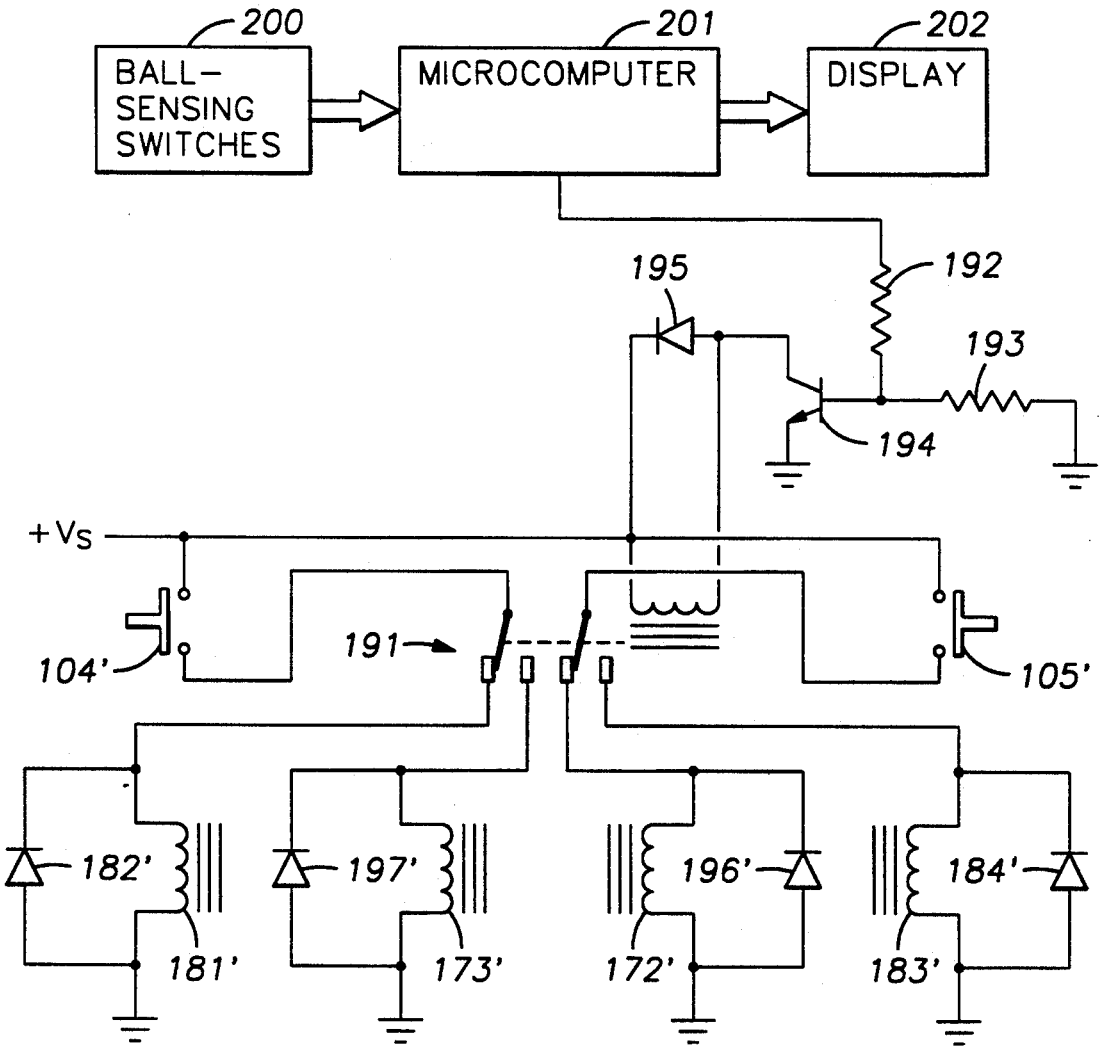
FIG. 7 is a schematic diagram showing an alternative method of wiring the solenoids of FIG. 5 to the player-operated flipper switches, so that the flipper switches activate either the solenoids of FIG. 5 or the solenoids that actuate the conventional flippers.

An alternative circuit is shown in FIG. 7. In this case, a microcomputer 201 operates a double-pole double-throw relay 191 so that the flipper switches 104', 105' activate either the solenoids 181', 183' of the flippers when the relay 191 is not energized, or the solenoids 172', 173' that move the elevated playfield when the relay 191 is energized. The relay 191 is energized in response to a logic signal from the microcomputer 201. The microcomputer 210 is responsive to ball-sensing switches 200 and operates a display 202 to display the player's score. A ball-sensing switch, for example, senses when the ball passes over the elevated ramp 125 in FIG. 1, and at this time the microcomputer 200 asserts the logic signal that energizes the relay 191. The microcomputer continues to assert the logic signal until the ball closes one of the ball-sensing switches 154' or 155' activated by the wire-forms 154 or 155 in FIG. 2 at the lower end of the elevated playfield section 110. The logic signal is applied through a voltage divider including resistors 192 and 193 to a transistor 194 that drives the relay 191. A damper diode 195 protects the transistor 194 when the transistor turns the relay 191 off. Each of the solenoids 181', 183', 172', 173' has a respective damper diode 182', 184', 196', 197' to prevent arcing at the switch and relay contacts.

Figure 8:
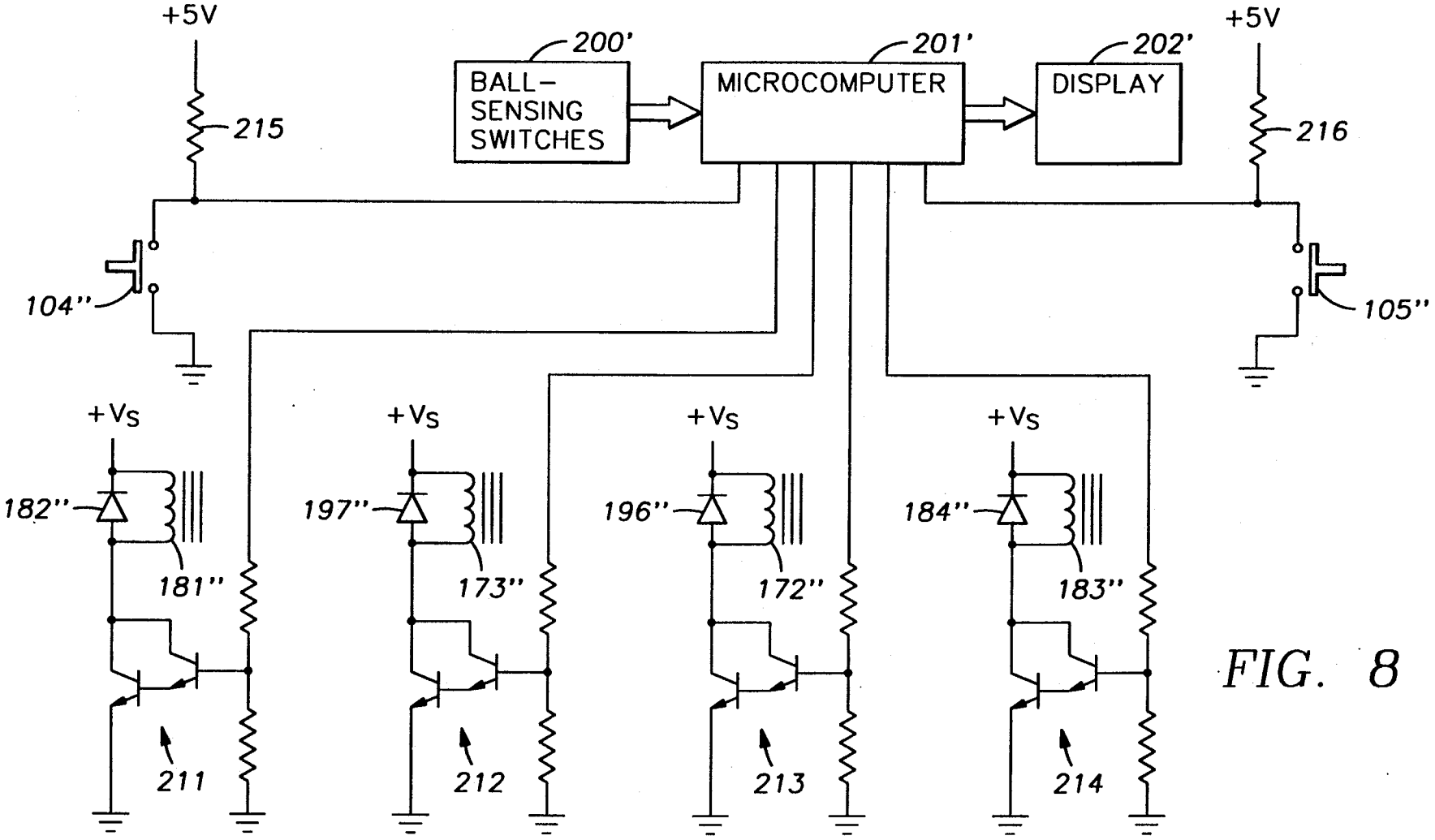
FIG. 8 is a schematic diagram showing yet another method of wiring the solenoids of FIG. 5 to the player-operated flipper switches, so that a microcomputer independently activates the solenoids of FIG. 5 or the solenoids that actuate the conventional flippers.

Yet another alternative circuit is shown in FIG. 8. In this circuit a microcomputer 201' independently operates each of the flipper solenoids 181'', 183'' and the solenoids 172'', 173'' which move the elevated playfield. The microcomputer 201' generates a respective logic signal applied to a respective Darlington transistor 211, 212, 213, 214, for driving each of the solenoids 181'', 173'', 172'', 183''. A pull-up resistor 215 is used in connection with the left flipper switch 104'' to provide a player-input logic signal to the microcomputer 201', and a pull-up resistor 216 is used in connection with the right flipper switch 105'' to provide another player-input logic signal to the microcomputer 201'. The microcomputer is also responsive to ball-sensing switches 200' for operating a display 202' to display a player's score, and can be programmed to perform the logic function of the relay 191 in FIG. 7. In addition, the microcomputer can be programmed to independently move the elevated playfield section 106 during a game sequence. For example, at the start of a game, the microcomputer 201' could move the rear end of the elevated playfield section from side-to-side to attract the player's attention.

Other alternative circuits could be used for activating the solenoids 172, 173 of FIG. 5 with the flipper switches 104, 105. For example, the flipper switches 104, 105 could be directly wired to the flipper solenoids 181, 183 as shown in FIG. 6, but the microcomputer (201 in FIG. 8) could sense the voltage across the flipper solenoids 181, 183 and independently activate the solenoids 172, 173 of FIG. 5 using transistor driver circuits as shown in FIG. 8.

Figure 9:
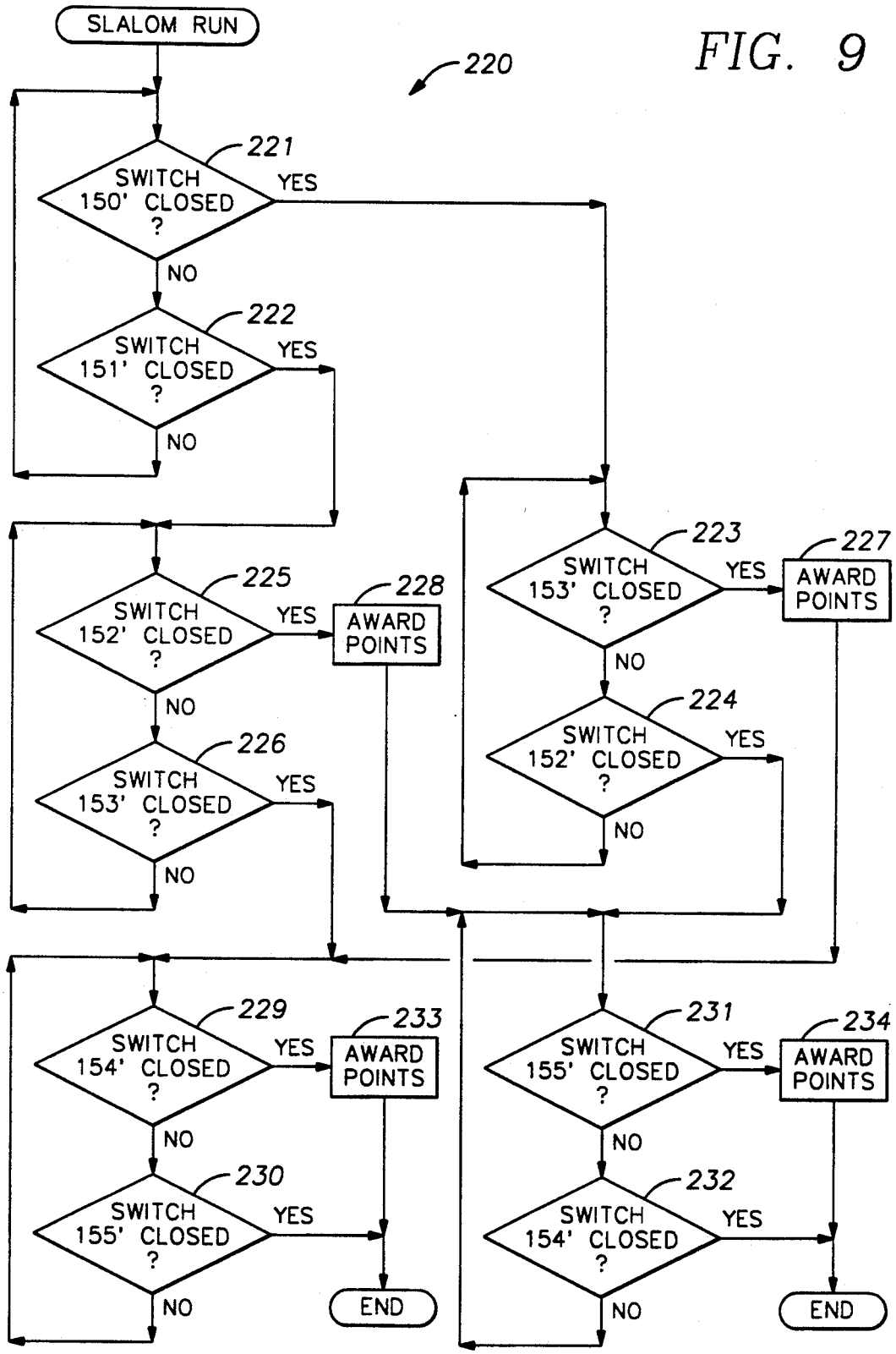
FIG. 9 is a flowchart of a program for awarding points to a player in response to ball-sending switches on the elevated playfield section of FIG. 2.

Turning now to FIG. 9, there is shown a flowchart generally designated 220 of programming for the microcomputer (201 in FIG. 7 or 201' in FIG. 8) to award the player points for causing the ball to shift between the lanes in the elevated playfield section 110 of FIG. 2. In the first steps 221 and 222, the microcomputer scans the switches 150' and 151' activated by the wire-forms 150 and 151 of FIG. 2 until the microcomputer finds that one of the switches is closed. When the microcomputer finds that the switch 150' is closed, in steps 223 and 224 the microcomputer scans the switches 153' and 152' activated by the wire-forms 153 and 152 in FIG. 2. When the microcomputer finds that the switch 151' is closed, the microcomputer also scans the switches 152' and 153', but in different steps 225 and 226. If switch 153' is found to be closed in step 223, then in step 227 the player is awarded points, because the ball has shifted lanes from the wire-form 150 to the wire-form 153 in FIG. 2. In a similar fashion, if switch 152' is found to be closed in step 225, then in step 228 the player is awarded points, because the ball has shifted lanes from the wire-form 151 to the wire-form 152 in FIG. 2.

When the microcomputer finds in step 226 that the switch 153' is closed, and after step 227, the microcomputer scans in steps 229 and 230 the switches 154' and 155' activated by the wire-forms 154 and 155 in FIG. 2. When the microcomputer finds in step 224 that the switch 152' is closed, and after step 228, the microcomputer also scans the switches 154' and 155', but in steps 232 and 231. If the microcomputer finds in step 229 that the switch 154' is closed, then in step 233 the player is awarded points, because the ball has shifted lanes from the wire-form 153 to the wire-form 154 of FIG. 2. If the microcomputer finds in step 230 that the switch 155' is closed, or after step 233, the "slalom run" is finished, and execution may return to steps 221 and 222 after the microcomputer performs other game functions. If the microcomputer finds in step 231 that the switch 155' is closed, then in step 234 the player is awarded points, because the ball has shifted lanes from the wire-form 152 to the wire-form 155 in FIG. 2. If the microcomputer finds in step 232 that the switch 154' is closed, or after step 234, the "slalom run" is finished, and execution may return to steps 221 and 222 after the microcomputer performs other game functions.

Figure 10:
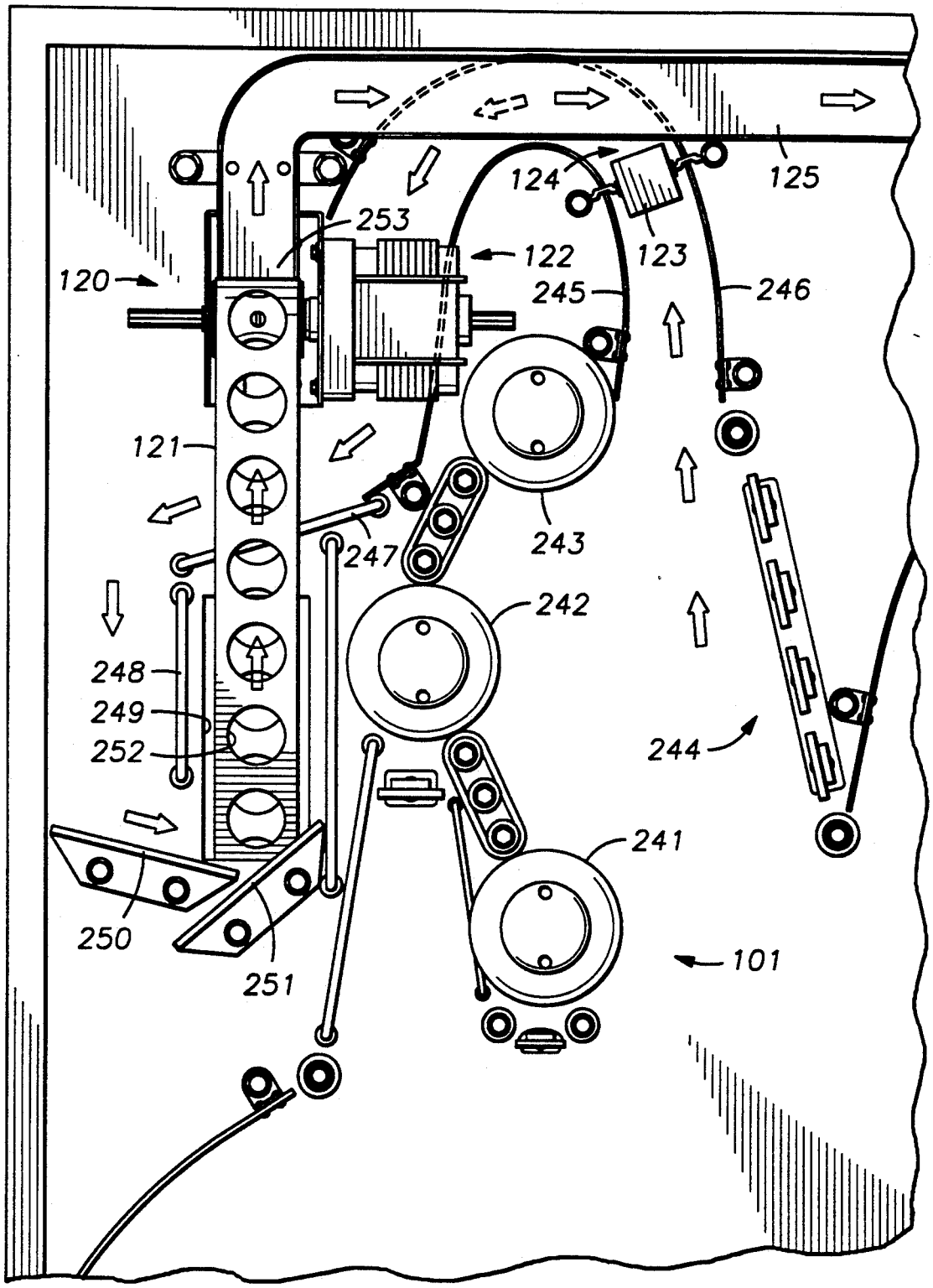
FIG. 10 is a plan view of an upper-left portion of the playfield in the pinball machine of FIG. 1, showing a conveyor belt for elevating the ball from the main playfield to the elevated playfield section of FIG. 2.

Turning now to FIG. 10, the ball elevator 120 is shown in greater detail in a plan view of an upper-left portion of the main playfield 101 in the pinball machine of FIG. 1. The path of the ball to and from the ball elevator 120 is depicted by a series of heavy arrows in FIG. 10.

To reach the ball elevator 120, the ball is projected by one of the flippers (106, 107 in FIG. 1) toward a checkered flag 123. The ball passes between a set of bumper targets 241, 242, 243 and a bank of stationary targets generally designated 244. The ball is received between a pair of curved metal guide strips 245, 246 forming a U-shaped channel 124 under the checkered flag 123, under the elevated vacuum-formed plastic ramp 125, and under the motor 122 of the ball elevator 120. A wire rail 247 guides the ball under the conveyor belt 121 of the ball elevator 120. The wire rail 247 and a wire rail 248 also prevent the ball from falling through a rectangular aperture 249 in the main playfield 101 through which the conveyor belt 121 passes.

A pair of brackets 250 and 251 guide the ball to fall into the lower end of the aperture 249 where the ball sits on the conveyor belt 121 until the ball is captured in a circular hole in the conveyor belt, such as the hole 252. The conveyor belt 121 then raises the ball up to an exit location 253 at the beginning of the elevated vacuum-formed plastic ramp 125, and the ball rolls down the ramp 125 toward the right, to be dropped onto the upper end of the elevated playfield section 110 shown in FIG. 1.

Figure 11:
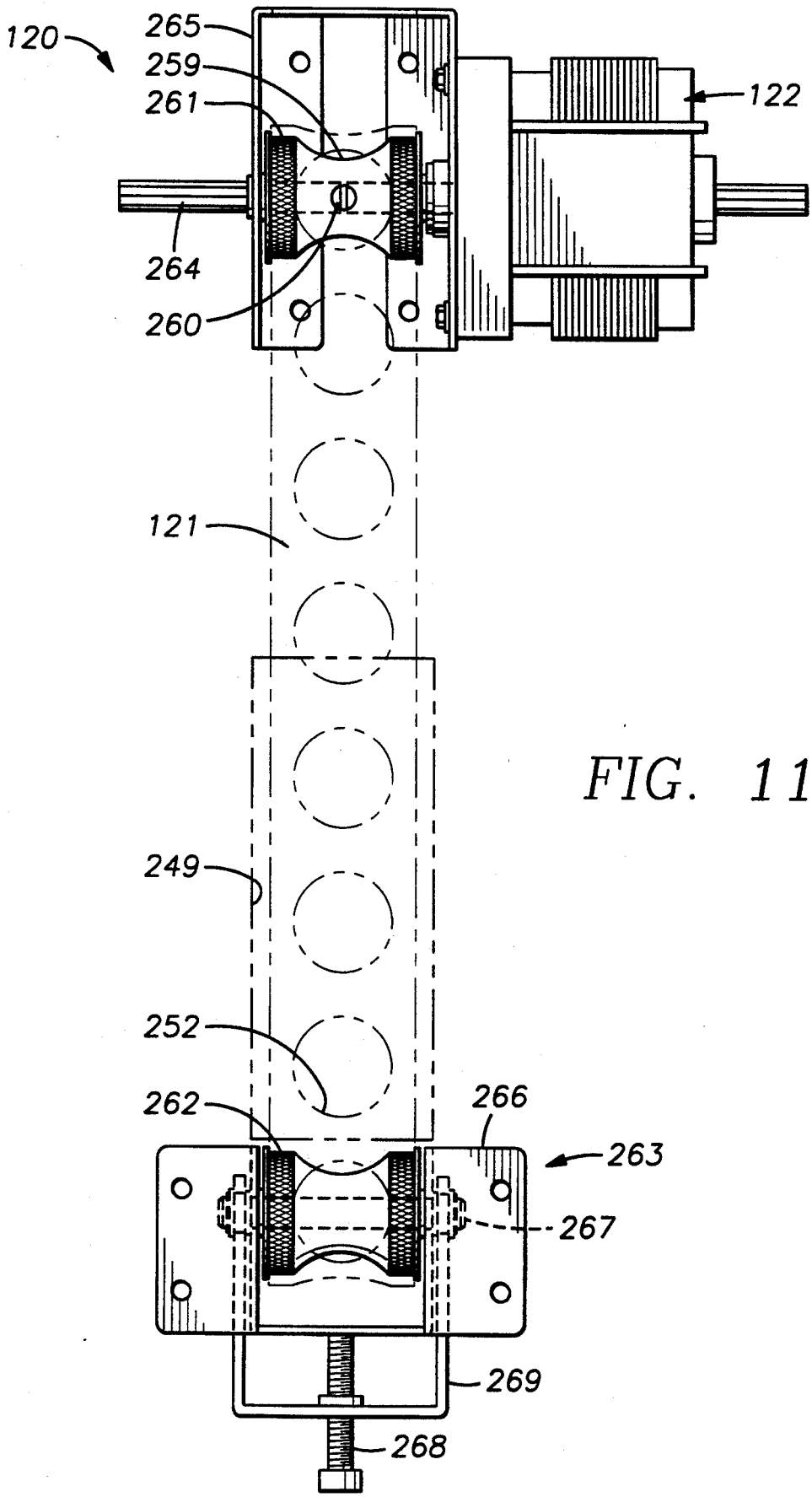
FIG. 11 is a plan view of the conveyor belt mechanism of FIG. 10, in which the belt and the main playfield are shown in phantom lines to expose the belt pulleys and the lower pulley assembly which is mounted underneath the main playfield.

Turning now to FIG. 11, there is shown a plan view of the conveyor belt mechanism of FIG. 10, in which the belt 121 and the aperture 249 of the main playfield are shown in phantom lines to expose the belt pulleys 261, 262 and the lower pulley assembly 263 which is mounted underneath the main playfield. A set screw 260 secures the upper pulley 261 to the shaft 264 of the motor 122. The motor 122 is mounted to the main playfield by a bracket 265 formed from sheet metal.

The upper pulley 261 has a central concave region 259 to prevent the upper pulley from prematurely ejecting the ball from the belt when the ball reaches the upper pulley. The upper pulley 261 is machined from aluminum, and the circumferential portions of the upper pulley, which contact the belt 121, are knurled to prevent the belt from slipping with respect to the upper pulley. For convenience, the lower pulley 262 is identical to the upper pulley.

The belt 121 preferably consists of molded polyurethane and polyester cord, and has an elasticity of about 80 to 85 derometer. The belt 121 is manufactured by cutting a strip to length, perforating the strip, and welding the ends of the strip together to form a continuous band. The belt can be purchased from Voss Belting & Specialties, 6965 North Hamlin Avenue, Lincolnwood, Ill. 60645.

The lower pulley assembly also has a sheet metal mounting bracket 266. The lower pulley 262 is mounted on a shaft 267 for free rotation with respect to its mounting bracket 266. In addition, the shaft 267 can translate forward and backward with respect to the mounting bracket 266 for tensioning the belt 121. The belt tension is adjusted by a screw 268 that abuts the mounting bracket 266 and is threaded to a U-shaped fork that pulls on the ends of the shaft 267.

Figures 12, 13:
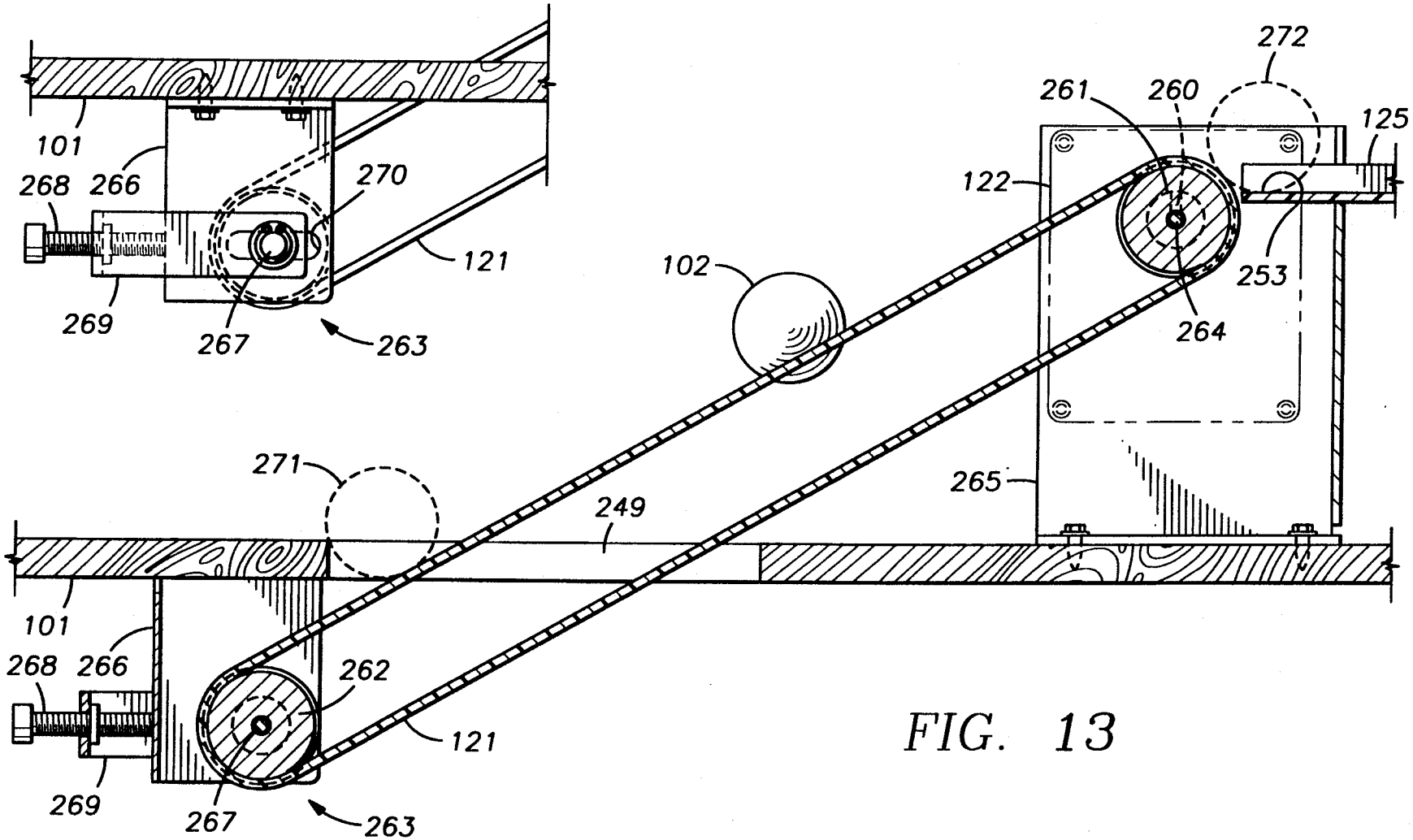
FIG. 12 is a side view of the lower pulley assembly.
FIG. 13 is a side view of the conveyor belt mechanism of FIG. 11, in cross-section, to illustrate the entrance and exit of a ball being elevated.

Turning now to FIG. 12, there is shown a side view of the lower pulley assembly 263. The mounting bracket 266 is screwed to the underside of the main playfield 101. To permit the shaft 267 to translate with respect to the mounting bracket 266 for adjustment of the belt tension, the near end of the shaft 267 passes through a horizontal slot 270 cut in the mounting bracket 163. The far end of the shaft 267 passes through a similar horizontal slot cut in the opposite side of the mounting bracket 266.

Turning now to FIG. 13, there is shown a side view of the conveyor belt mechanism of FIG. 11, in cross-section, to illustrate the entrance and exit of the ball 102 being elevated. At an entrance position 271 shown in phantom lines, the ball sits on the belt 121 and a rear wall of the rectangular aperture 249. At an exit position 272 shown in phantom lines, the ball is tangent to the outer surface of the belt 121 around the upper pulley 261, and the ball is also tangent to the upper surface of the elevated ramp 125 at an entrance point 253 on the ramp. The ball 102 passes above and over the upper pulley 261 when being conveyed by the conveyor belt 121 from the entrance position 271 to the exit position 272. Also shown in FIG. 13, in phantom lines, is an outline of the motor 122, which is raised off of the main playfield 101 to permit the ball to roll underneath the motor.

As described above, the rear end of the elevated, playfield (110 in FIG. 1) is mounted to a pair of solenoids for movement in opposite directions along a lateral axis, and the front end of the elevated playfield is pivotally mounted. For a slalom skiing game, this mounting arrangement has the advantage of increased difficulty of controlling the ball as the ball rolls forward, as if the ball represents a skier who is skiing faster when reaching the bottom of the hill. This increased difficulty is desired for maintaining the interest of the more skillful players. For other games, however, it might be desirable to mount the front of the elevated playfield section to a second pair of solenoids wired in parallel with the first pair of solenoids, so that the entire elevated playfield section is translated uniformly.

As described above, the rear end of the elevated playfield section is moved in opposite directions, to the left or to the right, along a horizontal axis, and the elevated playfield section is sloped downward in a direction generally perpendicular to the horizontal axis. In particular, this horizontal movement is achieved by a limited degree of rotation of the elevated playfield section about the pivot standoff (161 in FIG. 3) which supports the front end of the elevated playfield section. This horizontal movement of the elevated playfield section permits the player to bump the ball between lanes that run down the slope of the elevated playfield section. For other games, however, it might be desirable to also permit the player to bump the ball upward with respect to the direction of slope, so as to keep the ball in play on the elevated playfield section for a longer length of time. For still other games, it might be desirable to further permit the player to make the ball jump up in a direction normal to the surface of the elevated playfield section, for example, to jump over obstacles mounted on the elevated playfield section and into holes in the elevated playfield permitting the ball to drop onto the main playfield.

Figure 14:
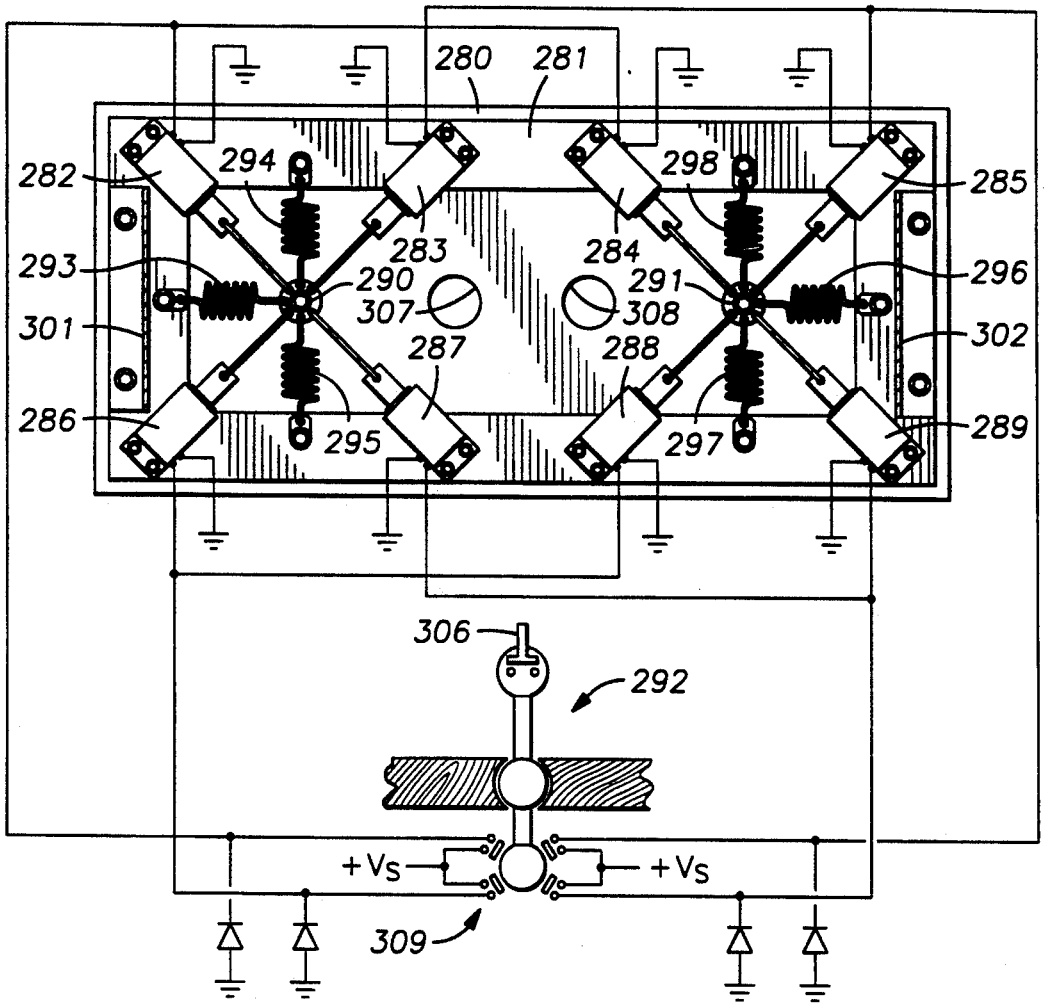
FIG. 14 is a bottom view of an alternative elevated playfield section in which the player may translate the elevated playfield section along any one of three orthogonal axes.
Figure 15:
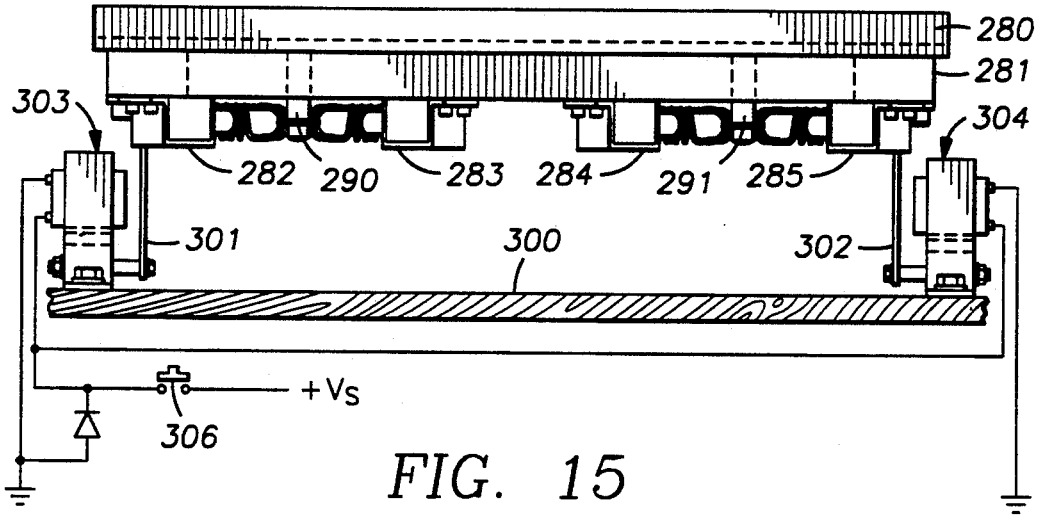
FIG. 15 is a side view of the elevated playfield section shown in FIG. 14.
Figure 16:
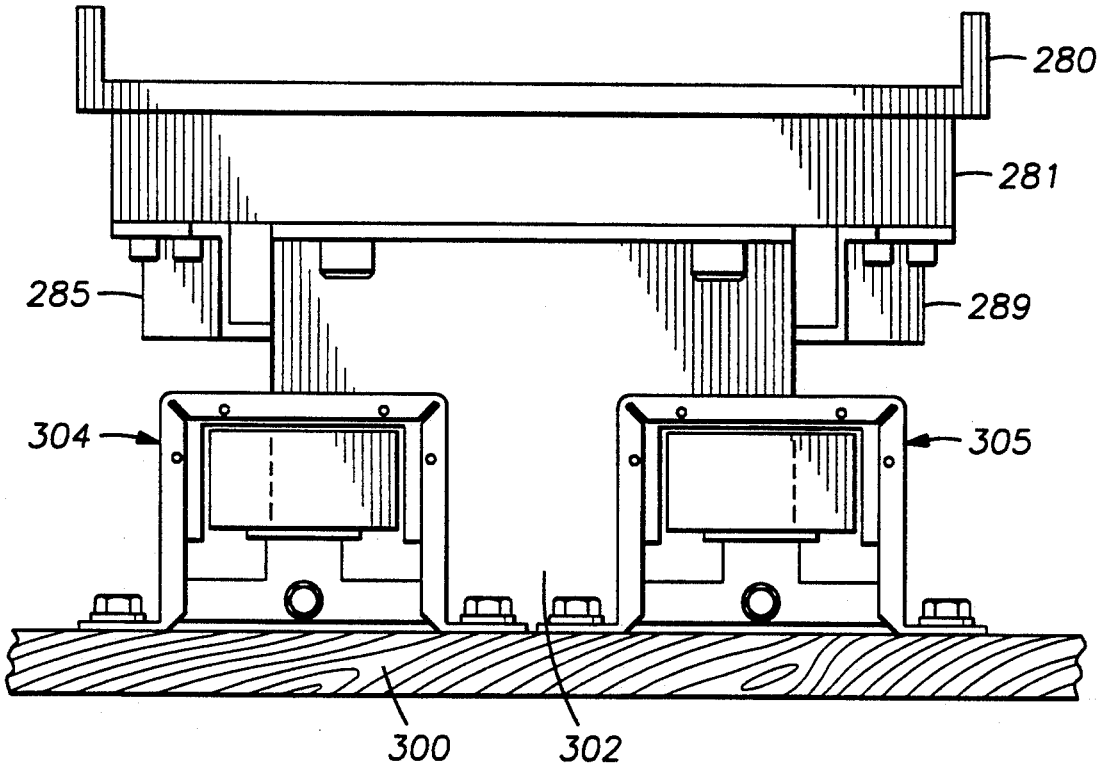
FIG. 16 is an end view of the elevated playfield section shown in FIG. 14.

Turning now to FIGS. 14, 15 and 16, there is shown an alternative construction for an elevated playfield section 280 in which the player may translate the elevated playfield section along any one of three orthogonal axes. In contrast to a rotation, a translation moves every point of the elevated playfield section parallel to and the same distance as every other point of the elevated playfield section. A bottom view looking upward at the elevated playfield section 280 is shown in FIG. 14. The elevated playfield section 280, for example, is an aluminum plate that rests on a wooden frame 281. Eight solenoids 282 to 289 are mounted to the bottom of the frame 281. The frame 281 has a rectangular aperture into which two spacers 290, 291 depend from the elevated playfield section 280. The spacer 290 is linked by wire links to the plunger shafts of the solenoids 282, 283, 286, 287, and the spacer 291 is linked by wire links to the plunger shafts of the solenoids 284, 285, 288, 289, so that the solenoids may translate the elevated playfield section 280 along different horizontal directions with respect to the frame 281. As shown in FIG. 14, for example, the solenoids are wired to four switches of a conventional joy-stick 292 to translate the elevated playfield section 280 along any one of eight different horizontal directions, depending on whether one or two of four directional switches 309 of the joy-stick are closed at any given time. When none of the joy-stick switches are closed, the elevated playfield section 280 is returned to a central position by extension springs 293, 294, and 295 mounted between the spacer 290 and the frame 281, and extension springs 296, 297, and 298 mounted between the spacer 291 and the frame 281.

As shown in the side view of FIG. 15 and the end view of FIG. 16, the frame 281 supporting the elevated playfield 280 is attached by brackets 301, 302 to the armatures of four solenoids mounted to a main playfield 300 below the four corners of the frame 281. Two of these four solenoids 303, 304 are shown in FIG. 15, and a third solenoid 305 is shown in the FIG. 16. All four of these solenoids are wired in parallel to a push-button switch 306 operated by the player. The push-button switch 306, for example, is the "trigger" switch of the joy-stick 292 in FIG. 14. When the player closes the push-button switch, the solenoids 303, 304, 305 cause the frame 281 and consequently the elevated playfield section 280 to rapidly jump upward, which will cause any ball on the elevated playfield section 280 to jump upward off of the elevated playfield section. The stroke of the solenoids 303, 304, 305 could be selected, for example by screws or shims mounted underneath the armatures of the solenoids, to select the height that the ball jumps above the elevated playfield section 280. An object of the game, for example, might be to cause the ball to jump into holes in the upper playfield section 280, for example, holes 307 and 308 as shown in FIG. 14.

In view of the above, there has been described a novel way of controlling a ball in a pinball machine. By movement of a playfield section, the player may deflect the ball to selected locations.

The specific embodiments shown in the drawings can be modified in various ways without departing from the scope of the invention as defined by the appended claims. Instead of being elevated off of a main playfield, the playfield section could be flush with the main playfield. Moreover, for certain games, the entire playfield could be translatable, for example in response to a joy-stick as described with reference to FIGS. 14 to 16, in which case the conventional flippers might not be used.

Although solenoids have been shown for moving the playfield section, other movement mechanisms could be used, such as electric motors or pneumatic actuators. Electric motors or pneumatic actuators, for example, could be controlled by a joy-stick in a servo-loop so that the position of the playfield section would track the position of the joy-stick. This could give the player more control over how hard the ball would be struck by the ball-deflecting components on the playfield section.

What is claimed is:

1. A method of inter-active control of a ball in a pinball machine in response to player input, said pinball machine having a plurality of ball-deflecting components mounted to a playfield section, said method comprising the steps of:

a) placing the ball on the playfield section; and b) selectively moving said playfield section in response to said player input, so that said ball is deflected by said ball-deflecting components to locations selected by said player.

2. The method as claimed in claim 1, wherein said pinball machine has a main playfield, said playfield section is mounted above said main playfield, and said step of placing the ball on the playfield section includes elevating the ball from the main playfield to the playfield section.

3. The method as claimed in claim 1, wherein said pinball machine has flippers controlled by player-operated push-button switches for projecting said ball, and said step of selectively moving is responsive to said player-operated push-button switches to move said playfield section in two different locations.

4. The method as claimed in claim 1, wherein said step of selectively moving moves said playfield section in different directions along two orthogonal axes.

5. The method as claimed in claim 1, wherein said step of selectively moving moves said playfield section in different directions along three orthogonal axes.

6. The method as claimed in claim 1, wherein said playfield section is planar, and said step of selectively moving moves said playfield section in a direction generally normal to said playfield section.

7. The method as claimed in claim 1, wherein said locations are different lanes defined by said ball-deflecting components on said playfield section.

8. The method as claimed in claim 7, wherein said step of selectively moving causes said ball to move between said lanes, and further comprising the step of awarding said player when said ball moves between said lanes.

9. A pinball machine comprising, in combination:

a main playfield having ball-deflecting components mounted thereon;

means operable by a player for projecting a ball over said main playfield to contact said components;

a playfield section mounted to said main playfield for movement with respect to said main playfield, said playfield section having ball deflecting-components mounted thereon for deflecting said ball when said ball rolls over said playfield section; and means operable by said player and connected between said playfield section and said main playfield for selectively moving said playfield section with respect to said main playfield to cause said ball to be deflected to selected locations by said ball-deflecting components mounted on said playfield section.

10. The pinball machine as claimed in claim 9, wherein said means for selectively moving comprises a pair of solenoids for moving said playfield section in different directions.

11. The pinball machine as claimed in claim 10, wherein said means for projecting said ball includes a pair of flippers activated by a pair of switches operated by said player, and wherein each of said solenoids is activated by a respective one of said switches.

12. The pinball machine as claimed in claim 9, wherein said playfield section is elongated, one end portion of said playfield section is pivotally mounted to said main playfield for pivoting about an axis generally perpendicular to said main playfield, and another end portion of said playfield section is mounted to said main playfield for movement by said solenoids in opposite directions along an axis generally parallel to said main playfield.

13. The pinball machine as claimed in claim 9, wherein said means for selectively moving moves said playfield section along an axis, said playfield section is sloped in a direction generally perpendicular to said axis, and said ball-deflecting components on said playfield section are arranged to define a plurality of sloping lanes.

14. The pinball machine as claimed in claim 13, wherein said playfield section includes ball-sensing switches for sensing when said ball travels in said lanes, said ball-deflecting components on said playfield section are mounted to permit said movement of said playfield to cause said ball to travel between said lanes, and further including means responsive to said ball-sensing switches for awarding said player when said ball travels between said lanes.

15. The pinball machine as claimed in claim 9, wherein said playfield section is elevated above said main playfield so that said ball may roll under said elevated playfield while rolling on said main playfield.

16. The pinball machine as claimed in claim 9, further comprising a microcomputer responsive to ball-sensing switches on said playfield section, and wherein said microcomputer is connected to said means for selectively moving in order to control said means for selectively moving.

17. A pinball machine comprising, in combination:

a main playfield having ball-deflecting components mounted thereon;

a pair of flippers for projecting a ball over said main playfield to contact said components;

a pair of switches operable by said player for activating said flippers;

a playfield section mounted to said main playfield for movement with respect to said main playfield, said playfield section having a plurality of ball-deflecting components mounted thereon; and a pair of solenoids coupled between said main playfield and said playfield section for moving said playfield section in different directions, said solenoids being electrically operable in response to said switches, whereby said player may control deflection of said ball by said ball-deflecting components on said playfield section.

18. The pinball machine as claimed in claim 17, wherein said playfield section is elongated, one end portion of said playfield section is pivotally mounted to said main playfield, and another end portion of said playfield section is mounted to said main playfield for movement by said solenoids in opposite directions along an axis.

19. The pinball machine as claimed in claim 17, wherein said playfield section is mounted to said main playfield for movement by said solenoids in opposite directions along an axis, said playfield section is sloped in a direction generally perpendicular to said axis, said ball-deflecting components on said playfield section are arranged to define a plurality of sloping lanes, and said playfield section includes ball-sensing switches for sensing when said ball travels in said lanes.

20. The pinball machine as claimed in claim 19, wherein said ball-deflecting components on said playfield section are mounted to permit said movement of said playfield to cause said ball to travel between said lanes, and further including a microcomputer responsive to said ball-sensing switches and programmed for awarding said player when said ball travels between said lanes.

21. The pinball machine as claimed in claim 17, wherein said playfield section is elevated above said main playfield so that said ball may roll under said elevated playfield while rolling on said main playfield.

22. A pinball machine comprising, in combination:

a housing;

a playfield section mounted to said housing for movement in different directions along at least two orthogonal axes, said playfield section having a plurality of ball-deflecting components mounted thereon;

a control operated by a player for selecting a direction along said at least two orthogonal axes; and means responsive to said control and connected between said housing and said playfield section, for moving said playfield section in the selected direction along said at least two orthogonal axes.

23. The pinball machine as claimed in claim 22, wherein said control is a joy-stick.

24. The pinball machine as claimed in claim 22, wherein said playfield section is planar, and further including means for moving said playfield section along a third orthogonal axis normal to said playfield section.

25. A method of inter-active control of a ball in a pinball machine in response to player input, said pinball machine having a plurality of ball-deflecting components mounted to a playfield section, said method comprising the steps of:

a) placing the ball on the playfield section; and b) selectively translating said playfield section in different directions along two orthogonal axes in response to said player input, so that said ball is deflected by said ball-deflecting components to locations selected by said player.

26. The method as claimed in claim 25, wherein said step of selectively translating translates said playfield section in different directions along three orthogonal axes.

* * * * *